US007097328B2

(12) United States Patent
Shemitz et al.

(10) Patent No.: US 7,097,328 B2
(45) Date of Patent: Aug. 29, 2006

(54) LUMINAIRE HEAT SINK

(75) Inventors: Sylvan R. Shemitz, Woodbridge, CT (US); Paul R. Ford, Orange, CT (US); Gregory L. Moler, Woodbridge, CT (US); Paul C. Johnson, Bethany, CT (US)

(73) Assignee: Sylvan R. Shemitz Designs, Inc., West Haven, CT (US)

( * ) Notice: Subject to any disclaimer, the term of this patent is extended or adjusted under 35 U.S.C. 154(b) by 204 days.

(21) Appl. No.: 10/723,447

(22) Filed: Nov. 24, 2003

(65) Prior Publication Data

US 2005/0111229 A1 May 26, 2005

(51) Int. Cl.
*F21V 29/00* (2006.01)

(52) U.S. Cl. ..... 362/264; 362/294

(58) Field of Classification Search ..... 362/264, 362/612

See application file for complete search history.

(56) References Cited

U.S. PATENT DOCUMENTS 4,600,857 A 7/1986 Suhar
4,773,723 A 9/1988 Cuda
4,858,089 A * 8/1989 Pietro ..... 362/294
5,204,578 A 4/1993 Dever et al.
5,329,436 A 7/1994 Chiu
D377,104 S 12/1996 Roberts
5,873,650 A 2/1999 Luk et al.
6,400,067 B1 6/2002 Manning et al.
6,406,163 B1 6/2002 Yang
6,715,900 B1 * 4/2004 Zhang ..... 362/294
6,787,999 B1 * 9/2004 Stimac et al. ..... 315/51

* cited by examiner

*Primary Examiner*—Ali Alavi
*Assistant Examiner*—Hargobind S. Sawhney
(74) *Attorney, Agent, or Firm*—Cantor Colburn LLP

(57) ABSTRACT

A heat sink for use with luminaires can be tightened securely against a lamp socket and can be loosened to allow the lamp socket to be rotated. The heat sink also contacts preferably an endplate or other structure of the luminaire having a preferably large amount of exterior surface area. Heat is drawn away from the lamp socket and interior of the luminaire via the heat sink to the endplate or other structure, where the heat is dissipated via convection into the surrounding air. By using another structure of the luminaire having a relatively large amount of surface area, the heat sink advantageously need not be large or bulky.

16 Claims, 4 Drawing Sheets

LUMINAIRE HEAT SINK

BACKGROUND OF THE INVENTION

This invention relates to luminaires. More particularly, this invention relates to heat absorbing devices (i.e., heat sinks) that remove heat from luminaires.

Conventional luminaires with low wattage lamps and relatively large housings typically do not exceed operating temperature limits because of heat generated by their lamps. Space within the luminaire and around the lamp(s) is often more than adequate to allow generated heat to dissipate harmlessly into the surrounding air via convection. Convection causes hotter air to rise higher than cooler air. Thus, so long as sufficient space is available, cooler air tends to be circulated toward a heat generating device as hotter air is naturally circulated away.

However, many new luminaires are compact in size and have high wattage lamps. Accordingly, more heat is generated in less space, rendering convective air cooling alone inadequate, and thus resulting in higher operating temperatures. These higher temperatures may exceed the lamp manufacturers' specifications, causing lamps to prematurely fail. Excessive heat may also cause other luminaire components or electrical connections to fail. Accordingly, heat removal from such compact, high wattage luminaires is an important design consideration.

Passive heat sinks are known. Such devices are typically metal or other thermally conductive material attached to a component from which heat is transferred to the heat sink. The heat then radiates from the heat sink into the surrounding air. In many cases, passive heat sinks provide sufficient cooling to maintain components below their specified temperature limits. However, for heat sinks to be effective, particularly in high heat environments, they should have large amounts of surface area from which to radiate the heat. The more surface area, the more heat that can be transferred from the attached component to the surrounding air. Accordingly, some heat sinks have numerous fins, bends, or folds to increase surface area. This, however, causes many heat sinks to be large and bulky, rendering them impractical for use in compact luminaires.

In view of the forgoing, it would be desirable to be able to provide a heat sink for a luminaire that can remove sufficient lamp heat to prevent premature lamp failure.

It would also be desirable to be able to provide a heat sink for a luminaire that is compact, installs securely against a lamp socket, allows lamp wiring to exit the socket, and still provides access to the socket when needed.

SUMMARY OF THE INVENTION

It is an object of this invention to provide a heat sink for a luminaire that can remove sufficient lamp heat to prevent premature lamp failure.

It is also an object of this invention to provide a heat sink for a luminaire that is compact, installs securely against a lamp socket, allows lamp wiring to exit the socket, and still provides access to the socket when needed.

In accordance with the invention, a heat sink is provided that advantageously fits unobtrusively around a lamp socket in a luminaire. Lamp bases typically have temperature limits that can be exceeded in compact high wattage luminaires. One embodiment of the heat sink has two semicircular parts that can be advantageously tightened against the lamp socket to ensure good heat transfer away from the socket. The heat sink parts can be loosened to allow the lamp socket to be oriented (e.g., rotated) as desired—this is advantageous when position-oriented lamp sockets are used. Furthermore, one of the two parts can be easily removed to provide access to the socket for maintenance, removal, etc. The heat sink also physically contacts and is preferably attached to an endplate of the luminaire. Heat absorbed by the heat sink is transferred to the endplate and quickly dissipated into the surrounding air via the relatively large exterior surface of the endplate. Moreover, the typically vertical position of the endplate allows convection currents of air to readily carry the heat away. In other embodiments of the invention, the heat sink can be in physical contact with other luminaire structures having large amounts of exterior surface area, such as, for example, a reflector or a reflector or luminaire housing (depending, of course, on the configuration of the luminaire). The heat sink may also be in physical contact with a separate plate that is parallel with and attached to an endplate via, for example, studs extending out of the endplate. Importantly, because the heat sink of the invention uses the relatively large exterior surface area of another structure in the luminaire, the heat sink itself can be small and thus used in compact luminaires and other apparatus having little space.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
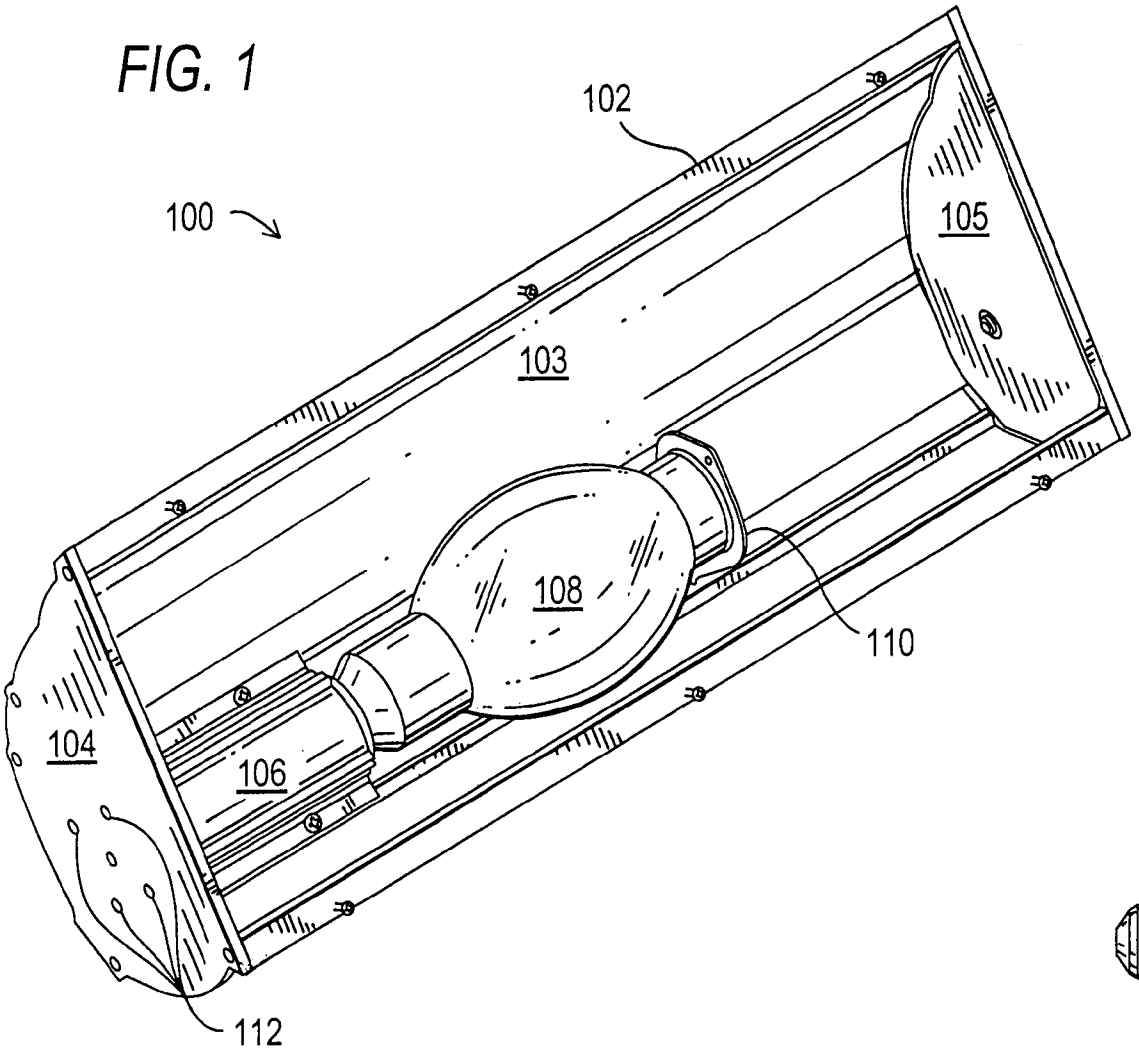
FIG. 1 is a perspective view of a luminaire having a heat sink in accordance with the invention.

FIG. 1 shows a luminaire in accordance with the invention. Luminaire 100 includes a reflector housing 102, reflector 103, two endplates 104 and 105, a heat sink 106, and a lamp 108. Lamp 108 is preferably a high wattage lamp inserted into a lamp socket that provides electrical connection to the lamp. Mounted around and against the perimeter surface of the lamp socket is heat sink 106, which also directly physically contacts and is preferably attached to endplate 104 with fasteners 112. Optionally, lamp bracket 110 is also included in luminaire 100. In addition to holding the other end of lamp 108, lamp bracket 110 can be advantageously used to ensure that lamp 108 is properly aligned with respect to the reflector.

Figure 2:
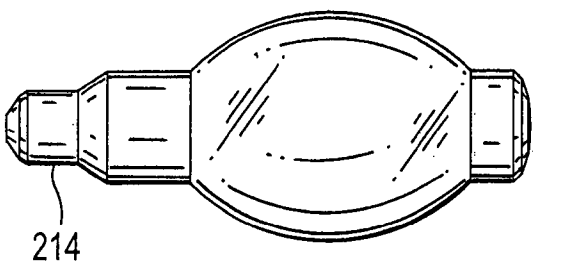
FIG. 2 is an elevational view of a high wattage lamp that can be used in the luminaire of FIG. 1.

FIG. 2 shows a high wattage lamp 208 having a base 214 that can be used in a luminaire of the invention. Lamp 208 can be, for example, a 1000 watt metal halide lamp. Manufacturers of such lamps specify maximum temperature limits under which the lamp should be operated. Base 214 is particularly vulnerable to excessive heat, because that is the lamp seal region (i.e., where the glass envelope is sealed to the base). Excessive heat can cause the lamp to fail prematurely. Such failure may include oxidation of the electrical conductors and/or a compromise of the lamp seal. Also, excessive heat can weaken the seal holding the glass envelope to the base, making removal of the lamp difficult and dangerous if the glass envelope separates from the base during removal.

Heat sink 106 draws heat from lamp 108 away from the lamp base and to endplate 104. The exterior surface of endplate 104 has a relatively large surface area that allows the heat to dissipate into the surrounding air. Because heat sink 106 transfers heat to endplate 104, heat sink 106 does not itself require large amounts of surface area (such as provided by, e.g., fins or multiple folds) and is therefore neither large, bulky, nor obtrusive with respect to luminaire 100.

Alternatively, heat sink 106 may instead be in physical contact with one or more other structures in luminaire 100. For example, luminaire 100 may include a separate plate that is parallel with and attached to endplate 104. Heat sink 106 can be attached to the separate plate, which can then be attached to endplate 104 via, for example, studs extending from endplate 104. In such a configuration, sufficient space should exist between endplate 104 and the separate plate to allow the heat from the separate plate to dissipate into the surrounding air.

Heat sink 106 is a thermally conductive material capable of withstanding preferably at least about 250° C. Aluminum is preferred; however, other materials, such as, for example, copper, aluminum alloys, other metals, and ceramics (e.g., silicon carbide and aluminum nitride) may be used provided they have high thermal conductivity and can withstand temperatures of at least about 250° C.

Figure 4:
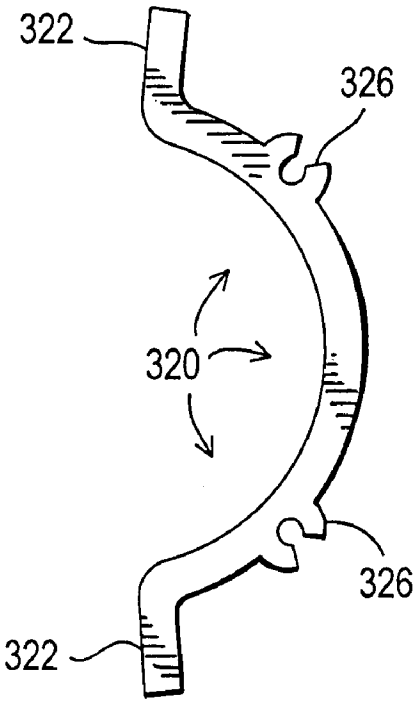
FIG. 4 is a side profile view of the heat sink part of FIG. 3.
Figure 3:
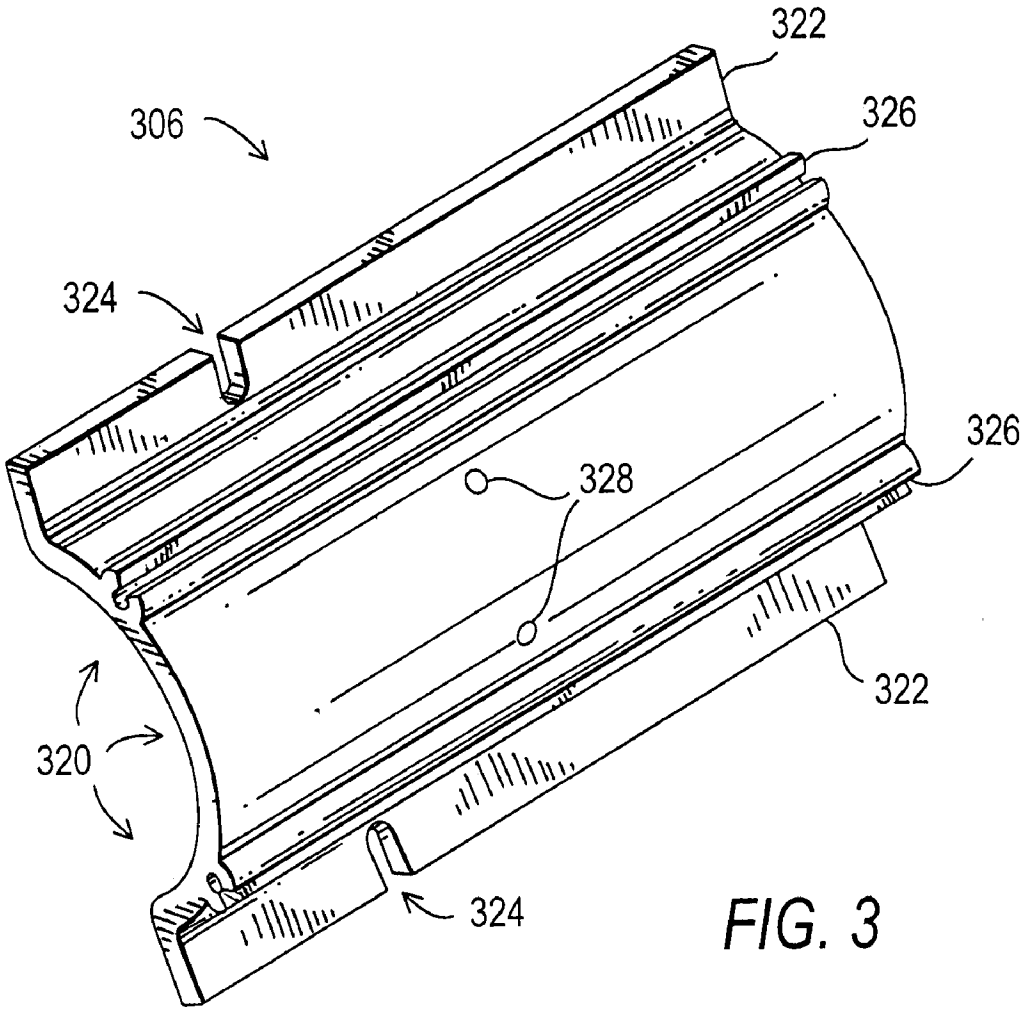
FIG. 3 is a perspective view of one part of a heat sink in accordance with the invention.

FIGS. 3 and 4 show an exemplary embodiment of one part of a heat sink in accordance with the invention. Heat sink part 306 has a semicircular profile shape 320. Each side of semicircular shape 320 preferably has a flange 322 extending therefrom. Each flange 322 preferably has a coupling point, which in this embodiment is a notch 324 sized to receive a fastener. At the coupling point, heat sink part 306 is coupled to a second heat sink part to form a hollow structure. The second heat sink part is preferably identical to part 306, but alternatively need not be. Assembly and installation of a heat sink in accordance with the invention is described in detail below with respect to FIGS. 5 and 6.

Heat sink part 306 is preferably manufactured by a hot forming process to create an extrusion of preferably aluminum. Such a process heats the aluminum until softened and then extrudes the softened aluminum under high heat and pressure through a die with openings that produce the desired cross-sectional shape. The extruded aluminum can then be cut into desired lengths. Alternatively, heat sink part 306 can be stamped, cold formed, hot formed in die castings, or formed in any other suitable process.

Heat sink part 306 preferably includes one or more screw tracks 326 running longitudinally (and in parallel if two or more tracks are present) along the exterior surface of part 306. Screw tracks 326 can be used to attach heat sink part 306 to a structure of a luminaire, such as, for example, an endplate.

Heat sink part 306 optionally includes two threaded screw holes 328 positioned such that inserted screws act as a stop when a lamp socket or other object is inserted in the hollow structure formed by part 306 and a second heat sink part. Alternatively, an appropriately positioned and sized indentation or dimple in part 306 can serve as a stop.

Alternatively, heat sink 106, and two heat sink parts 306, can be extruded as a single almost fully circular (or other desired shape) hollow piece with a small gap separating the two longitudinal sides. One or more respective coupling points on each of the longitudinal sides are where the one-piece heat sink can be clamped against a lamp socket in a manner similar, if not identical, to the two-piece heat sink.

Figure 5:
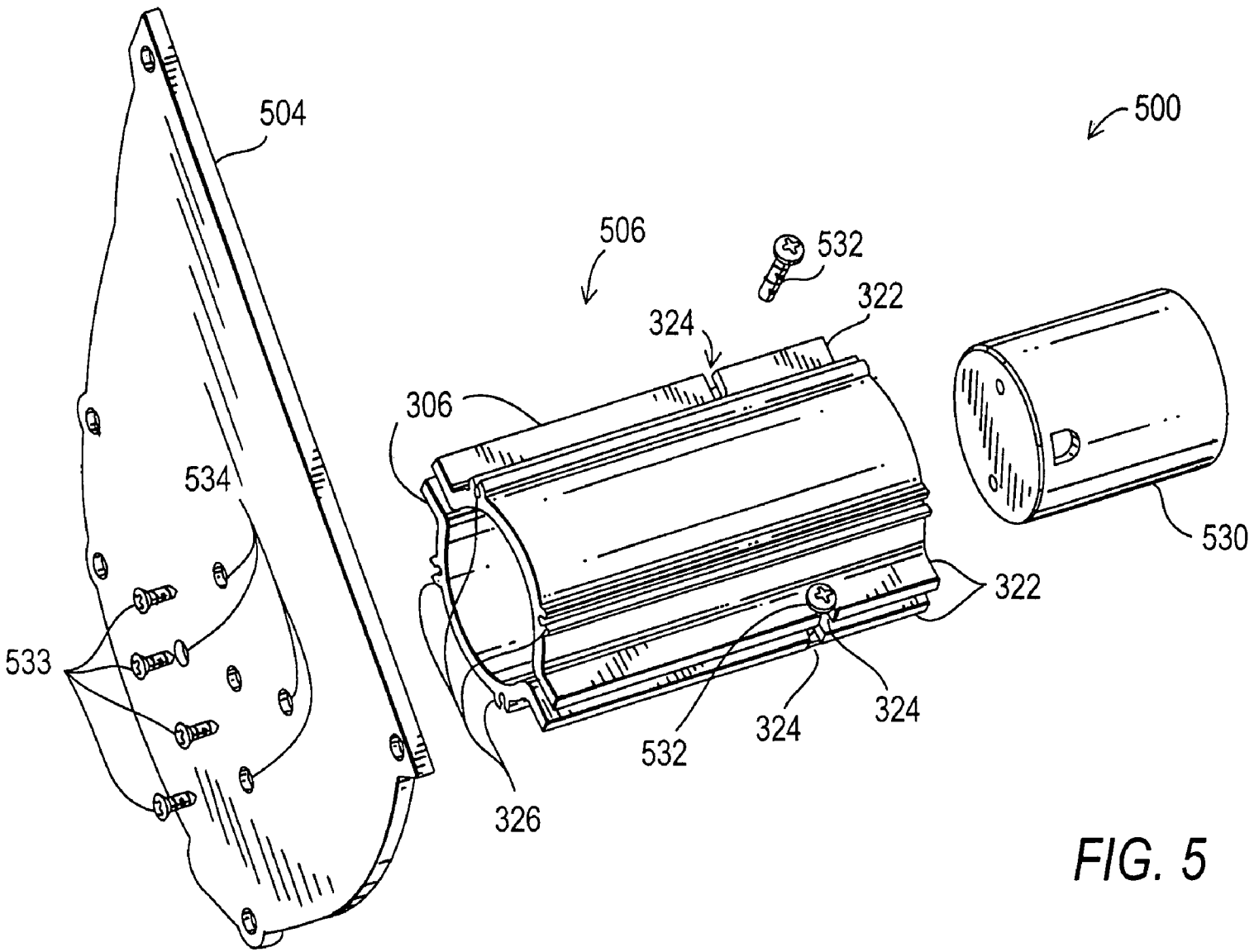
FIG. 5 is a perspective view of a luminaire endplate, heat sink, and lamp socket in accordance with the invention.
Figure 6:
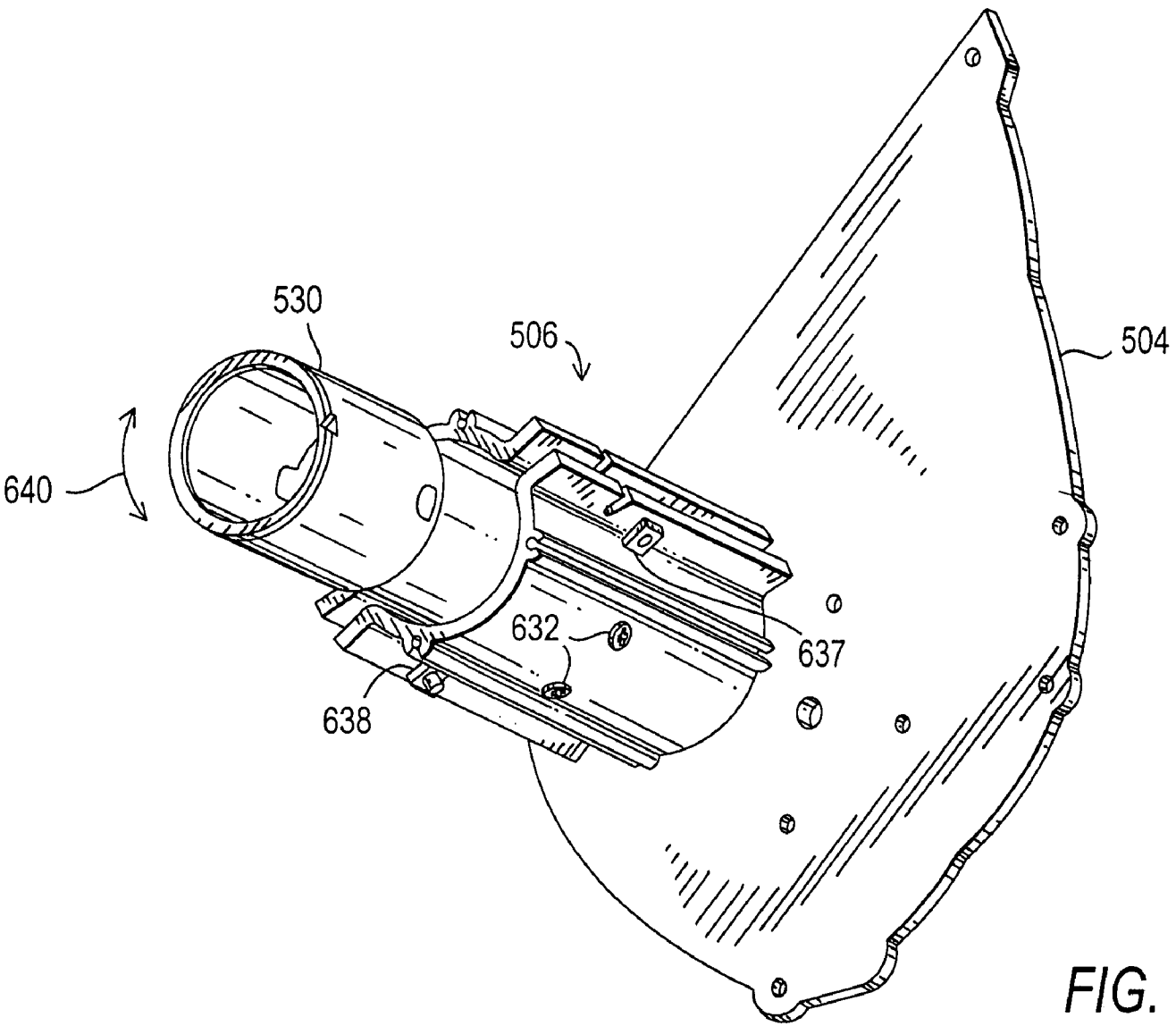
FIG. 6 is another perspective view of the endplate, heat sink, and lamp socket of FIG. 5.

FIGS. 5 and 6 show a heat sink assembly in accordance with the invention. Assembly 500 includes endplate 504 and heat sink 506. Heat sink 506 includes two heat sink parts 306 coupled together to form a hollow cylindrically shaped structure having two open ends. Heat sink 506 is operative to receive a lamp socket 530. Respective notches 324 of each heat sink part 306 are aligned and operative to receive fasteners 532 to couple the two parts 306 together. Advantageously, fasteners 532 are also used to tighten heat sink 506 against lamp socket 530. This ensures that each heat sink part 306 is in direct physical contact with a corresponding portion of the exterior surface of lamp socket 530. Advantageously, even after parts 306 have been coupled together and tightened against lamp socket 530 (or other object), a space still preferably exists between respective flanges 322 of first and second parts 306 along the cylindrical shape such that one or more wires can pass between. Such wires may be from, for example, lamp socket 530.

When assembled, heat sink 506 is in direct physical contact with endplate 504 and is preferably attached thereto. In this embodiment, heat sink 506 is fastened to endplate 504 via fasteners 533 through holes 534 in endplate 504 into screw tracks 326 of heat sink parts 306.

Optional holes 328 on one of heat sink parts 306, appropriately positioned, can be used to receive screws or other hardware 632, as shown in FIG. 6, that can serve as stops to prevent lamp socket 530 from being inserted too far inside of heat sink 506. Thus, heat sink 506 can be used to set the longitudinal and lateral position of lamp socket 530 within the luminaire.

Fasteners 532, 533, 632, and 637 can be screws, wing nuts, rivets, clips, pins, carriage bolts, types of strapping (e.g., hose clamps), or other appropriate hardware. Screws could be used with separate nuts 637 (advantageously prevented from rotating by the semicircular portion of part 306) or with nuts 638 integrated in flanges 322. Alternatively, screws 532 can be used with threaded holes instead of notches 324. Moreover, fasteners 532 and perhaps notches 324 may be replaced at the coupling points by one or more types of clamping or adjustable clip hardware that can couple two sink parts together as well as tighten the two parts against an object positioned between them. In another embodiment of the invention, the heat sink part 306 positioned in the rear of the luminaire may be welded to endplate 504. Still further, that part 306 may be attached to endplate 504 with a high-temperature adhesive, provided that the adhesive did not interfere significantly with the conduction of heat from part 306 to endplate 504 and was not adversely affected by that heat.

By loosening fasteners 532, heat sink parts 306 can be loosened with respect to each other and lamp socket 530. This advantageously allows lamp socket 530 to be oriented (e.g., rotated as indicated by arrow 640 in FIG. 6) as desired. This feature is important should a position-oriented lamp socket be used. The rotational position of such sockets and their respective lamps can affect the light color and/or life of the lamps.

Furthermore, one of heat sink parts 306 can be separately removed from a luminaire by removing fasteners 532 and two of fasteners 533, while the other heat sink part 306 remains attached to endplate 504. This provides convenient access to lamp socket 530 for maintenance, replacement, and the like.

Note that heat sinks of the invention need not have a semicircular profile shape, but can have other shapes to match the shape of whatever luminaire component or object is intended to be protected from excessive heat. For example, heat sinks of the invention may have a rectangular or other polygonal profile shape.

Thus it is seen that heat sinks for luminaires are provided. One skilled in the art will appreciate that the invention can be practiced by other than the described embodiments, which are presented for purposes of illustration and not of limitation, and the present invention is limited only by the claims which follow.

We claim:

1. A heat sink assembly of a luminaire, said assembly comprising:

an endplate of said luminaire, said endplate comprising an interior surface and an exterior surface of said luminaire;

a first heat sink piece; and a second heat sink piece coupled to said first heat sink piece to form a hollow structure having two opposite ended openings, said hollow structure operative to receive and be tightened against a lamp socket; wherein said first and second pieces are in physical contact with said endplate.

2. The assembly of claim 1 further comprising a plurality of fasteners that couple said first and second heat sink pieces together and that attaches said first and second pieces to said endplate.

3. The assembly of claim 1 further comprising a lamp socket inserted in said hollow structure.

4. The assembly of claim 1 wherein said hollow structure has a space between said first and second pieces along a side of said structure to allow electrical wiring to pass through.

5. The assembly of claim 1 wherein said hollow structure has a stop to prevent insertion of a lamp socket beyond a certain point.

6. The assembly of claim 5 wherein said stop is an indentation or a screw in one of said first and second pieces.

7. A luminaire comprising:

first and second endplates;

a reflector positioned between said first and second endplates;

a heat sink attached to one of said endplates, said heat sink comprising:

a first piece, and a second piece coupled to said first piece to form a hollow structure having an open end; and a lamp socket held in place between said first and second pieces of said heat sink; wherein:

said heat sink is in direct physical contact with said lamp socket and said one endplate and is operative to be tightened against said lamp socket.

8. The luminaire of claim 7 wherein said lamp socket is operative to receive a 1000 watt metal halide lamp.

9. The luminaire of claim 7 wherein said heat sink has screw tracks running along exterior surfaces of said first and second pieces, said heat sink attached to said one endplate via screws through said endplate and into said screw tracks.

10. A method of drawing heat away from a lamp socket of a luminaire, said method comprising:

contacting a portion of an exterior surface of said lamp socket with a first piece of thermally conductive material;

contacting another portion of said exterior surface of said lamp socket with a second piece of thermally conductive material; and contacting a thermally conductive structure of said luminaire with said first and second pieces of thermally conductive material, said structure comprising an exterior surface of said luminaire.

11. The method of claim 10 further comprising tightening said first and second pieces of thermally conductive material against said portion and said another portion of said exterior surface of said lamp socket.

12. The method of claim 10 further comprising fastening said first and second pieces of thermally conductive material to said thermally conductive structure to maintain said contacting of said thermally conductive structure.

13. The method of claim 10 wherein said structure is an endplate of said luminaire.

14. A method of drawing heat away from a lamp socket of a luminaire, said method comprising:

tightening first and second pieces of thermally conductive material against a lamp socket to ensure direct physical contact between said lamp socket and said first and second pieces;

transferring heat to said first and second pieces; and transferring heat from said first and second pieces to a thermally conductive structure of said luminaire, said first and second pieces in direct physical contact with said structure, said structure comprising an exterior surface of said luminaire.

15. The method of claim 14 further comprising passing electrical wiring between said first and second pieces while said first and second pieces are tightened against said lamp socket.

16. The method of claim 14 further comprising providing a removable said first piece to allow said lamp socket to be accessed.

* * * * *